US008881497B2

(12) United States Patent
Zenzen

(10) Patent No.: US 8,881,497 B2
(45) Date of Patent: Nov. 11, 2014

(54) METHOD FOR REMOVING AND DRAWING A SYNTHETIC THREAD AND A DEVICE FOR PERFORMING THE METHOD

(75) Inventor: Dirk Zenzen, Leverkusen (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 375 days.

(21) Appl. No.: 13/383,493

(22) PCT Filed: Sep. 29, 2009

(86) PCT No.: PCT/EP2009/062642

§ 371 (c)(1),
(2), (4) Date: Mar. 26, 2012

(87) PCT Pub. No.: WO2011/009497

PCT Pub. Date: Jan. 27, 2011

(65) Prior Publication Data

US 2012/0180450 A1 Jul. 19, 2012

(30) Foreign Application Priority Data

Jul. 22, 2009 (DE) ..... 10 2009 034 200

(51) Int. Cl.
*D01D 5/16* (2006.01)
*D01D 5/098* (2006.01)

(52) U.S. Cl.
CPC . *D01D 5/16* (2013.01); *D01D 5/098* (2013.01)
USPC ..... 57/310

(58) Field of Classification Search
CPC ..... D01D 5/08; D01D 5/12; D01D 5/16; D01D 5/084; D01D 5/098
USPC ..... 57/310; 264/165, 555
See application file for complete search history.

(56) References Cited

U.S. PATENT DOCUMENTS 1,975,132 A * 10/1934 Van Derhoef ..... 34/389
4,902,462 A * 2/1990 Bert ..... 264/103

(Continued)

FOREIGN PATENT DOCUMENTS

DE 31 46 054 A1 8/1982
DE 35 08 955 A1 9/1986

(Continued)

OTHER PUBLICATIONS

International Search Report from International Application No. PCT/EP2009/062642, mailed Jan. 4, 2010.

(Continued)

*Primary Examiner* — Shaun R Hurley
(74) *Attorney, Agent, or Firm* — Alston & Bird LLP

(57) ABSTRACT

The invention relates to a method and a device for removing and drawing a synthetic thread to form a fully drawn yarn. The thread is formed by joining a plurality of extruded filaments and is guided by contact on the circumference of heated guide jackets of several driven galette pairs. In order to obtain a gentle and highly homogenized treatment of the filaments, the thread is guided in an S-shaped or Z-shaped thread course by a first galette pair having two guide jackets driven in opposite directions during the removal from a spinning zone and before the drawing. Thus, both sides of the thread can be brought directly into circumferential contact with the guide jackets for in order to heat the thread.

15 Claims, 4 Drawing Sheets

(56) References Cited

U.S. PATENT DOCUMENTS

| | | | | |
|---|---|---|---|---|
| 5,643,515 | A * | 7/1997 | Davies | 264/103 |
| 5,750,151 | A * | 5/1998 | Brignola et al. | 425/66 |
| 5,763,859 | A * | 6/1998 | Wirz et al. | 219/619 |
| 6,887,423 | B2 * | 5/2005 | Van Trump et al. | 264/555 |
| 2003/0034585 | A1 * | 2/2003 | Locher et al. | 264/210.8 |
| 2003/0064650 | A1 | 4/2003 | Van Trump | |

FOREIGN PATENT DOCUMENTS

| | | | |
|---|---|---|---|
| DE | 199 58 245 | A1 | 6/2000 |
| DE | 10 2005 045496 | A1 | 3/2007 |
| EP | 0 691 424 | A | 1/1996 |
| JP | 60 151312 | A | 8/1985 |
| JP | 9-268429 | A | 10/1997 |
| JP | 9-268430 | A | 10/1997 |
| JP | 2000-129530 | A | 5/2000 |
| WO | WO 02/12603 | A | 2/2002 |
| WO | WO 2007/115703 | A1 | 10/2007 |

OTHER PUBLICATIONS

Written Opinion for International Application No. PCT/EP2009/062642, mailed Jan. 4, 2010.

International Preliminary Report on Patentability for International Application No. PCT/EP2009/062462, isued Feb. 7, 2012.

Office Action for Japanese Application No. 2012-520914 dated Apr. 30, 2013.

* cited by examiner

METHOD FOR REMOVING AND DRAWING A SYNTHETIC THREAD AND A DEVICE FOR PERFORMING THE METHOD

BACKGROUND OF THE INVENTION

1. Field of the Invention

The method relates to a method for removing and drawing a synthetic thread to form a fully drawn yarn (FDY) as well as a device for performing the method.

2. Description of Related Art

For the manufacture of synthetic threads especially for textile applications it is generally known that the multifilament threads are drawn to a lesser or greater extent after the melt spinning process, depending on the yarn types to be manufactured. Depending on the degree of drawing, we distinguish between so-called POY yarns or FDY yarns. POYs (pre-oriented yarns) have a pre-oriented, not yet completely drawn structure and are normally further processed into the finished yarn during a second process step, such as false turn texturizing. In contrast, FDYs (fully drawn yarns) are fully drawn and can be used directly for the subsequent processing of a large-size textile product.

The synthetic threads are drawn by means of driven guide jackets of several galettes, wherein the threads are guided with contact along the circumference of the guide jackets. The guide jackets of the galettes are at least partly heated to heat the threads for drawing or relaxing. Because strong drawing analogously requires high differential speeds between the guide jackets and the galettes on the one hand and the threads are heated by way of contact with the heated guide jackets on the other hand, long contact lengths between the thread and guide jacket are required to heat the threads with high speeds. For this reason, a galette pair is normally used for removing and drawing synthetic threads to form fully drawn yarns, said galettes having two guide jackets driven with identical circumferential speeds and guiding the thread with several loops. Said method and said device have been disclosed for example in DE 199 58 245 A1.

With respect to the disclosed method and the disclosed device, each of the galette pairs comprises two driven guide jackets, on which the thread is guided with a plurality of loops. In this respect the guide jackets of a galette pair interact in order to carry out the thermal treatment on the thread and to pull the thread out of a spinning zone or to draw it in a drawing zone. The number of loops on the guide jackets is selected in such a way according to the ratio of speeds that the desired drawing temperature is reached when the thread has run off of the guide jacket. However, any contact between the thread and a guide surface generally generates friction effects which may result in irregularities of the individual filaments due to the multifilament structure of the thread.

A method and a device for removing and drawing a multifilament thread has been disclosed in DE 31 46 054 A1, in which the thread is guided along the guide jacket of a galette with a single loop for removing the thread. However, the guide jacket is not heated and therefore, the thread is drawn cold in the subsequent zone. However, said cold drawn threads generally have the disadvantage that extremely high drawing forces need to be generated, resulting in considerable problems especially in connection with the manufacture of a plurality of simultaneously guided threads. Another disadvantage of the method is that the consistently slip-free transmission of the drawing forces is extremely difficult with a single loop on the guide jacket of the galette.

However, methods and devices have generally been disclosed in the prior art in which the thread is heated contactless by means of a radiant panel. For example, a method and a device for removing and drawing a multifilament thread are described in WO 2007/115703 A1 in which the thread is guided on the guide jackets of the galettes with a single loop. In the process, free treatment zones used to heat the thread with radiant panels are formed between the guide jackets. Consequently, said methods and devices require longer free guide pathways of the thread to allow adequate temperature equalization with high speeds.

SUMMARY OF VARIOUS EMBODIMENTS

The object of the invention is to create a method and a device for removing and drawing a multifilament thread to form a FDY yarn of the type according to its genre which allows gentle heating of the thread with high removal speeds and relatively short contact lengths between the thread and the guide jackets.

Another object of the invention is to provide a method and a device of the type according to its genre which allows the heat treatment and drawing on the smallest possible installation space.

According to the invention, this object is solved with the various method embodiments described herein as well as with the various embodiments of a device for performing the method described herein.

Preferred upgrades of the invention are defined by the characteristics and combination of characteristics of the various alternate embodiments described herein.

The invention is based on the know-how that the type of thread guidance of synthetic threads affects the heating of the thread for textile applications with fine titers. In the prior art, the threads are generally looped multiple times in the same looping direction around galette pairs with two driven and heated guide jackets. As a result of said type of thread guidance, the multifilament thread has an inner side and an outer side and the filament strands arranged on the inner side of the thread are recurrently guided past the heated surface of the guide jackets of the galette pair. As a result, the filament strands of the thread arranged on the outer side are exclusively heated by way of heat transport within the filament bundle. However, as a result of this effect, the heat treatment of the individual filaments within the filament bundle of the thread is uneven, thus causing irregularities for example in connection with the staining during a subsequent process.

The invention has the particular advantage that the thread on the guide jackets of the galette pair is heated uniformly from both sides. For this purpose, the thread is guided in an S-shaped or Z-shaped thread course through a first galette pair having two guide jackets driven in opposite directions during the removal from a spinning zone and before the drawing. This achieves a high uniformity for heating the filaments of the thread on the one hand and allows the realization of a relatively short contact length with high speeds of the guide jackets on the other hand. In particular, this makes it possible to essentially homogenize the history of the thread filaments. The filament strands arranged both on the inner side as well as on the outer side of the thread come into contact with the heated surface of one of the guide jackets.

For this purpose, the device for performing the method according to the invention comprises a galette pair, in which the drives of the guide jackets are formed with two electric motors with a different sense of rotation and which are driving the guide jackets with identical circumferential speeds. Thus, the guide jackets can optimally interact with each other in order to remove the thread or a plurality of threads guided parallel side by side from a spinning zone.

The upgrade of the method in which the thread is guided through a second galette pair in an S-shaped or Z-shaped thread course with guide jackets driven in opposite directions after the drawing, whereby the thread is drawn in a drawing zone formed between the galette pairs, is particularly suitable for the thermal after-treatment of the thread to achieve a relaxation. In spite of the high circumferential speeds of the guide jackets of the second galette pair due to the drawing, a uniform heating of the thread can be achieved with a relatively short contact length. Again the thread from an inner side and an outer side alternately comes into contact with the heated surface of the guide jackets. This results in a particularly even treatment of all filament strands within the thread and rapidly achieves the thermodynamic end status of the thread.

In order to obtain a high loop-related friction for establishing high drawing forces with a single looping of the guide jackets aside from an adequate contact length for heating up the thread, the upgrade of the invention is particularly advantageous in which the thread is guided past the guide jackets of the galette pair with a single partial loop with a looping angle of at least 180o. With common galette diameters with a range of for example 150 to 250 mm, this allows the safe drawing of all common titer ranges of FDY yarns, irrespective of the polymer material.

In order to draw one or a plurality of threads simultaneously to form an FDY yarn, the heat is matched to the respective thread material, so as to reach the range of uniformly flowing drawing depending on the polymer type, so that a uniform molecular structure can be created during the drawing process.

In order to achieve adequate heat with alternating contact of the thread with the heated surfaces of the guide jackets irrespective of the number of filaments combined to form the thread and irrespective of the filament titers, the upgrade of the invention is preferably used in which the two guide jackets of the first galette pair are heated to the same surface temperature or the respective different surface temperatures for heating the thread before the drawing.

This effect is provided in particular also for the thermal after-treatment following the drawing of the thread, so that according to an upgrade of the invention the two guide jackets of the second galette pair are heated to the same surface temperature or to different surface temperatures for heating the thread after the drawing procedure.

For performing the method variant, the device according to the invention preferably has a separate heating system for every guide jacket, which can be controlled independently from each other by means of a plurality of control devices provided for setting a surface temperature on the respective guide jacket.

However, it is generally also possible to heat one of the guide jackets, preferably the guide jacket of the galette pair downstream of the thread course passively, for example by means of the thermostated ambient air present within the galette box.

Furthermore, the separate heating of the guide jackets for generating different surface temperatures is particularly advantageous to obtain a uniform heating of all filaments on one galette pair with different contact lengths between thread and guide jacket and with identical guide speeds of the two guide jackets.

This also makes it possible to use guide jackets with different diameters for alternately heating the inner side and the outer side of the thread. For example, the surface temperature of the guide jacket with a smaller exterior diameter would be set higher. The differences in diameter of the guide jackets of one of the galette pairs can at the same time be used to set a speed difference. In particular, this triggers a shrinkage process in the filaments of the thread in connection with the after-treatment of the thread after the drawing, which is formed in particular in the last galette pair between the guide jackets.

However, for performing the method the device variant is preferably selected in which the guide jackets of one of the galette pairs have an identical outer diameter for the formation of identical contact lengths between thread and guide jacket with the same size partial loop. However, the contact lengths can also be varied with different partial loops on the guide jackets.

In order to heat the thread material with surface temperatures of the guide jackets that are as low as possible and hence with as little energy as possible, the method variant is particularly advantageous in which the thread is removed in dry status or in a wet status with a low water content of <20%, preferably <10%. Consequently, the thermal energy provided on the surface of the guide jacket is utilized directly to heat the thread material. This helps completely prevent or minimize foreign components on a thread, so that no energy is wasted to heat said foreign components of a thread.

The uniformity of the filaments respective to the thread length can be optimized with the method variant in which the filaments of the thread are guided into a ribbon-shaped arrangement before a first contact with the guide media. Thus, all filaments combined in one thread can come into contact with the guide jackets of the galette pair so that each of the filaments essentially has the same history with respect to the heating of the surface contact.

For performing this method variant, the device according to the invention comprises a guide medium upstream of the thread course of the first galette pair and through which the filaments of the thread can be transferred into a ribbon-shaped arrangement.

In order to be able to set the drawing ratios common for FDY yarns flexibly, the method variant is provided in which the thread is guided along the circumference of the guide jackets of the first galette pair with a circumferential speed of the guide jackets in the range of 1,200 m/min to 3,500 m/min and along the circumference of the guide jackets of the second galette pair with a circumferential speed of the guide jackets in the range of 3,500 m/min to 6,000 m/min. Thus, all common polymer types with different thread titers can be made into an FDY yarn. Especially with thicker thread titers, the method according to the invention can be improved by additionally heating the thread contactless by means of infrared irradiation. Said additional heating can be performed both before drawing as well as after drawing the thread, wherein preferably free thread lines are used for this purpose.

BRIEF DESCRIPTION OF THE SEVERAL VIEWS OF THE DRAWINGS

The method according to the invention as well as the device according to the invention for performing the method are explained in detail below by means of an exemplary embodiment with reference to the enclosed figures.

In the figures.

DETAILED DESCRIPTION

Figure 1:
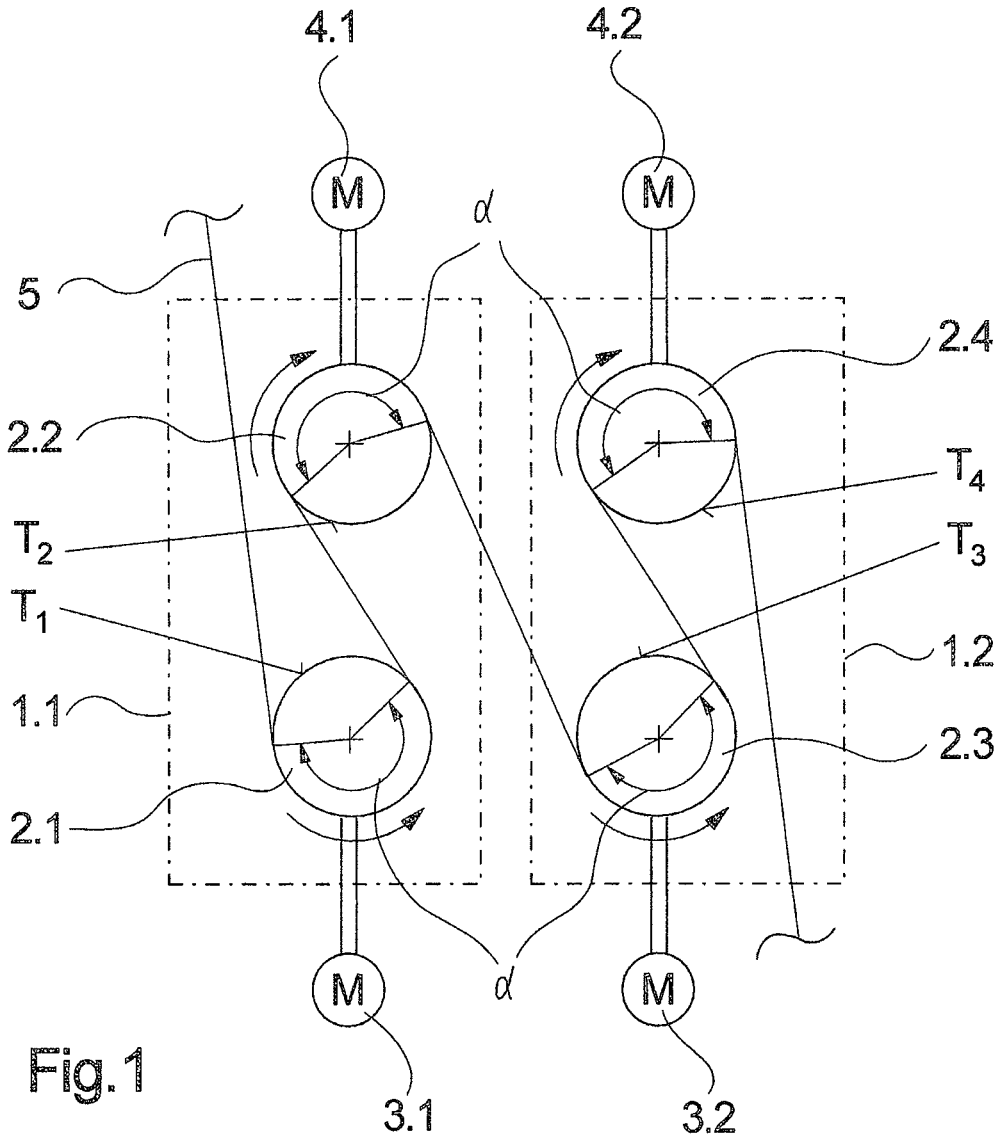
FIG. 1 shows a schematic representation of a galette arrangement of a first exemplary embodiment of the device according to the invention for performing the method according to the invention

FIG. 1 shows a galette arrangement of a first exemplary embodiment of the device according to the invention for performing the method according to the invention.

The exemplary embodiment is formed with two galette pairs 1.1 and 1.2, which are arranged side by side. The first galette pair 1.1. has two guide jackets 2.1 and 2.2 driven at the same circumferential speed. The guide jackets 2.1 and 2.2 of the galette pair 1.1 are arranged on top of each other and are each driven by a separate electric motor 3.1 and 4.1. The electric motor 3.1 of the guide jacket 2.1 is designed with left-hand rotation and drives the guide jacket 2.1 in a counter clockwise direction. The electric motor 4.1 is designed with right-hand rotation and drives the guide jacket 2.2 in a clockwise direction. Consequently, the guide jackets 2.1 and 2.2 are turning in opposite directions. The electric motors 3.1 and 4.1 are preferably driven by a common motor control device. Each of the guide jackets 2.1 and 2.2 comprises a heating system not illustrated here, provided to heat the guide jackets 2.1 and 2.2. Thus, the guide jacket 2.1 is heated to a surface temperature $T_1$ and the guide jacket 2.2 to a surface temperature $T_2$.

In this case, the second galette pair 1.2 is designed identically to the first galette pair 1.1. This means that the guide jackets 2.3 and 2.4 are driven by the electric motors 3.2 and 4.2, wherein a speed difference for the shrinkage treatment can be set between the guide jackets 2.3 and 2.4. The electric motor 3.2 is designed with left-hand rotation and drives the guide jacket 2.3 in a counterclockwise direction. The electric motor 4.2 is designed with right-hand rotation and drives the guide jacket 2.4 in a clockwise direction. Again, both guide jackets 2.3 and 2.4 of the galette pair 1.2 are driven in opposite directions, wherein the electric motors 3.2 and 4.2 are preferably driven by a motor control device. Furthermore, a separate heating system (not illustrated here) is assigned to each guide jacket 2.3 and 2.4, so that the guide jackets 2.3 and 2.4 can be heated with different temperatures. As a result, the guide jacket 2.3 has a surface temperature $T_3$ and the guide jacket 2.4 a surface temperature $T_4$.

In order to remove a multifilament thread from a spinning device and to draw it to form an FDY yarn, a thread 5 is first removed from the guide jacket 2.1 of the galette pair 1.1 and guided in an S-shaped thread course around the guide jacket 2.1 and the adjacent guide jacket 2.2. In the process, the thread 5 is first brought into contact with one inner side on the guide jacket 2.1 with a single loop and then brought into contact with its outer side on the surface of the guide jacket 2.2 by changing the loop direction. This way, the filaments on the inner side and outer side of the thread 5 can alternately be brought into direct contact with the heated surface of the guide jackets 2.1 and 2.2.

In this exemplary embodiment the guide jackets 2.1 and 2.2 are designed with an outer diameter of identical size, wherein the arrangement of the galette pairs 1.1 and 1.2 is selected in such a way that the looping angle of the thread 5 on the guide jackets 2.1 and 2.2 each exceeds a value of 180o. In FIG. 1, the loop angle is labeled with the letter a. It is basically possible to form different loop angles, depending on the galette arrangement on the guide jackets 2.1 and 2.2. Furthermore, a Z-shaped looping of the guide jackets 2.1 and 2.2 would be possible with the mirror-inverted feed of the thread.

In order to heat the thread material to a temperature within the range of the gas conversion temperature or also above the gas conversion temperature, the guide jackets 2.1 and 2.2 are heated with identical surface temperatures in this exemplary embodiment. As a result, the surface temperature $T_1$ of the guide jacket 2.1 is identical to the surface temperature $T_2$ of the guide jacket 2.2 and could be within the range of 60° C. to 200° C.

However, it is also possible to set different surface temperatures $T_1$ and $T_2$ on the guide jackets 2.1. and 2.2. This is necessary in particular in cases where the single looping of the thread 5 on the guide jackets 2.1 and 2.2 results in different contact lengths, for example because of different diameters of the guide jackets or due to different loop angles on the guide jackets.

The second galette pair 1.2 is arranged next to the first galette pair 1.1 wherein the thread 5 is directly guided to the lower guide jacket 2.3 of the galette pair 1.2 after coming off the guide jacket 2.2. As a result, a drawing zone is formed between the guide jackets 2.2 of the first galette pair 1.1 and the guide jacket 2.3 of the second galette pair 1.2, in which the multifilament thread 5 is drawn. For this purpose, the guide jackets 2.3 and 2.4 of the second galette pair 1.2 are driven with a higher circumferential speed than the guide jackets 2.1 and 2.2 of the first galette pair 1.1. The thread 5 is guided around the guide jackets 2.3 and 2.4 of the second galette pair with an S-shaped loop, so that the thread 5 can be guided with a single loop inside the galette arrangement. This allows the realization of extremely compact and short guide jackets within the galette pair 1.1 and 1.2.

The galette pair 1.2 is essentially designed identical to galette pair 1.1, and therefore, the outer diameters of the guide jackets 2.3 and 2.4 are identical. However, it is also possible to obtain a speed difference on the galette pair 1.2 desired for the after-treatment of the thread where the rotational speed is the same and the outer diameters of the guide jackets 2.3 and 2.4 are different. Irrespective of the size of the outer diameter, a loop angle a is formed on each of the guide jackets 2.3 and 2.4, which normally exceeds the value of 180o. In order to introduce a thermal after-treatment of the drawn thread directly inside the second galette pair 1.2, the guide jackets 2.3 and 2.4 are heated to a surface temperature in the range of 80 to 200o C. In this exemplary embodiment, the surface temperatures $T_3$ of the guide jacket 2.3 and the surface temperature $T_4$ of the guide jacket 2.4 are set to identical values. However, it is basically again possible to create different surface temperatures on the guide jackets 2.3 and 2.4, in order to equalize for example the contact lengths between the thread and the guide jackets. Normally, the surface temperatures of the guide jackets 2.3 and 2.4 are set higher than the surface temperatures of the guide jackets 2.1 and 2.2. This is due to the fact that different temperatures are required to initiate certain thread-specific processes and that the circumferential speeds of the guide jackets 2.3 and 2.4 are naturally considerably higher than the guide speeds of the guide jackets 2.1 and 2.2 and therefore realize different direct contact times. The galette pair 1.1 is preferably driven with a guide speed in the range of 1,200 in/min to 3,500 in/min. The second galette pair 1.2 is driven with a guide speed ranging between 3,500 and 6,000 in/min.

Figure 2:
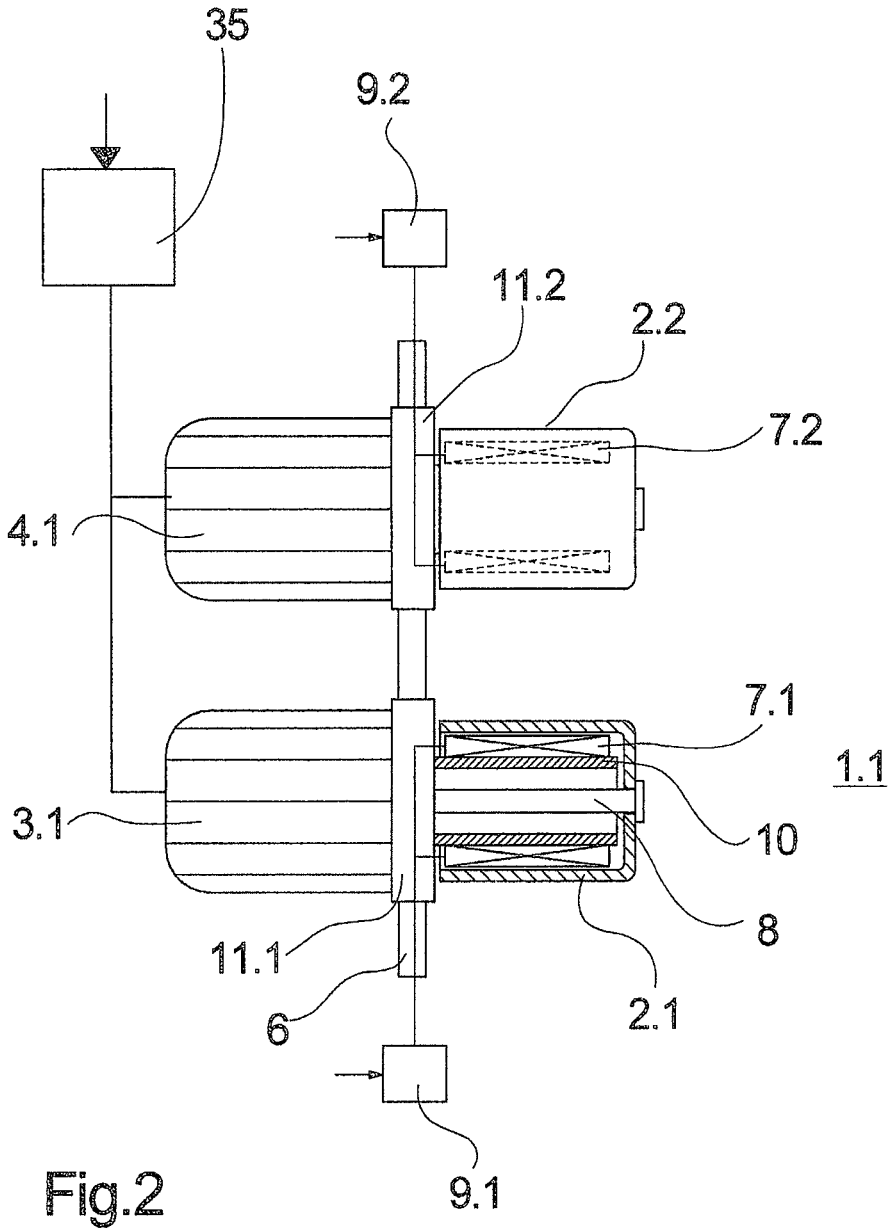
FIG. 2 shows a schematic cross-section of a galette pair pursuant to the exemplary embodiment according to FIG. 1

FIG. 2. illustrates a schematic cross section of a galette pair, such as it could be used for instance as galette pair 1.1 or as galette pair 1.2 in the exemplary embodiment according to FIG. 1. In this case, galette pair 1.1 is illustrated. The galette pair 1.1 is fastened on a machine rack 6. For this purpose, two galette retainers 11.1 and 11.2 are arranged at a distance from each other on the machine rack 6 on which the guide jackets 2.1 and 2.2 are pivotably retained. The design of the guide jackets 2.1 and 2.2 is identical and therefore, only guide jacket 2.1 is illustrated as a cross-sectional representation in FIG. 2. The guide jacket 2.1 is connected with a drive shaft 8 which is driven by the electric motor 3.1. The guide jacket 2.1 is designed as a hollow cylinder and its jacket is put over a heating system 7.1. The heating system 7.1 which can be formed for instance with an induction coil, is retained on a heating retainer 10 and electrically connected with an external control device 9.1. The control device 9.1 is used to set a desired surface temperature on the guide jacket 2.1. The sensors intended to control and monitor the surface temperature are not illustrated in this exemplary embodiment.

Consequently, the galette pair 1.1 comprises control devices 9.1 and 9.2 used for the independent control and regulation of the connected heating systems 7.1 and 7.2 of the assigned guide jackets 2.1 and 2.2.

In order to drive the guide jackets 2.1 and 2.2, the electric motor 3.1 with left-hand rotation and the electric motor 4.1 with right-hand rotation are operated jointly by means of a motor control device 35 with identical rotational speeds. If the outer diameters of the guide jackets 2.1 and 2.2 are identical, the latter are driven with identical circumferential speeds. For this purpose, the electric motors 3.1 and 4.1 of the galette pair 1.1 are connected with the motor control device 35.

We would like to point out that the structural design of the galette pair according to FIG. 2 is exemplary. Other structural principles can generally also be used to drive and heat a guide jacket. For example, passive heating of at least one of the guide jackets by way of thermal convection and external heat irradiation is also possible. The galette pairs are normally arranged inside a galette box to prevent in particular the loss of heat. The thermal energy built up within the galette box due to an actively heated guide jacket could be used to heat the neighboring not actively heated guide jacket. Furthermore, it is also possible to arrange additional heat sources within the galette box, such as for instance an infrared radiator used to heat a thread or the thread on the surface of the guide jacket directly.

In addition, simulation calculations revealed that the surface temperatures of the guide jackets of a galette pair must be selected depending on the free thread distance between the guide jackets. The introduced thermal energy which is additionally influenced by the surroundings is equalized within the filament bundle. Long thread distances between the guide jackets result in a better distribution of the thermal energy in the multifilament thread and so the surface temperature on the subsequent guide jacket of the galette pair can be kept below the surface temperature of the first guide jacket. The method according to the invention and the device according to the invention can also be operated in a variant in which one of the guide jackets of the galette pair is kept mobile in order to change the free thread distance between the guide jackets. Aside from the length of the free thread distance, it is also possible to influence the loop degree and hence the contact lengths between the thread and the guide jacket with the mobility of the guide jacket. Therefore, the invention offers a number of many flexible uses in order to create an FDY yarn.

Figure 3:
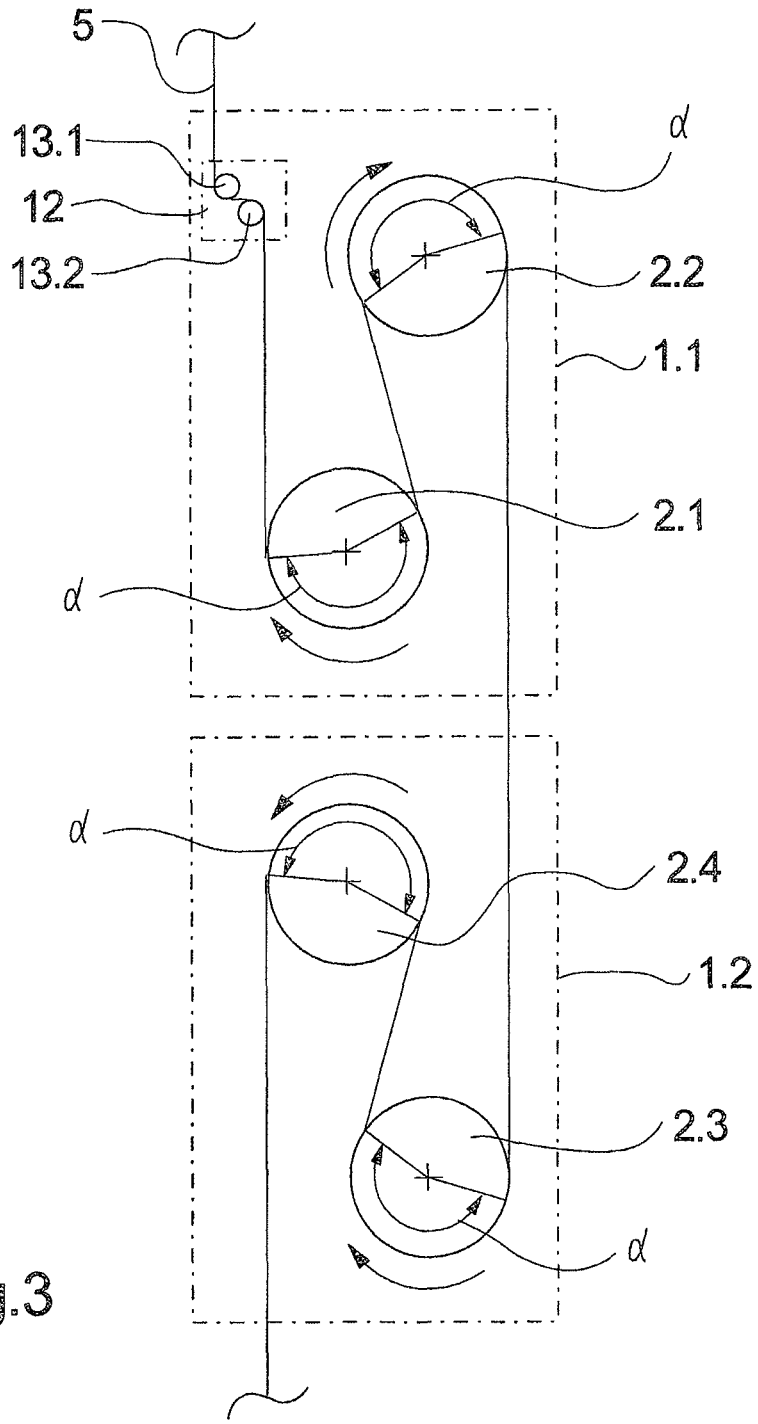
FIG. 3 shows an additional galette arrangement of another exemplary embodiment of the device according to the invention

Another exemplary embodiment of a galette arrangement is illustrated in FIG. 3, used to perform the method according to the invention. In this exemplary embodiment the galette pairs 1.1 and 1.2 are arranged underneath each other. The design of the galette pairs 1.1 and 1.2 is identical to the exemplary embodiment according to FIG. 1. Therefore, we are referring to the description above and only explain the differences below.

To remove the multifilament thread from a spinning device, a guide medium 12 is arranged in front of the thread course in the first galette pair 1.1. In this exemplary embodiment, the guide medium 12 is formed with two return pulleys 13.1 and 13.2 mounted freely pivotable. The thread 5 is guided along the return pulleys 13.1 and 13.2.with one partial loop each, whereby the filaments of the thread 5 create a ribbon-shaped arrangement. Insofar, the thread 5 is guided to the guide jacket 2.1 of the first galette pair 1.1 with a ribbon-shaped filament arrangement. The thread 5 is looped around the guide jackets 2.1 and 2.2 of the first galette pair 1.1 in an S-shape with identical circumferential speed and driven in opposite directions. The ribbon-shaped filament alignment achieves a high homogenization for the heating and guidance of the thread. It also continues after the thread 5 has been drawn in the drawing zone and results in a homogeneous after-treatment on the guide jackets 2.3 and 2.4 of the second galette pair 1.2. The arrangement of the galette pairs 1.1 and 1.2 among each other creates an extended drawing zone, which runs in between the guide jackets 2.2 and 2.3. In this arrangement, the thread is looped around the guide jackets 2.3 and 2.4 of the second galette pair 1.2 in a Z-shape. For this purpose, the guide jacket 2.3 is driven in a clockwise direction by an electric motor with right-hand rotation (not illustrated here). The second guide jacket of the second galette pair 1.2 is therefore driven in a counterclockwise direction by an electric motor with left-hand rotation with identical circumferential speed.

Here we would like to emphasize explicitly that the design of the galette pairs 1.1 and 1.2 in the exemplary embodiment according to FIG. 1 and FIG. 3 is exemplary. The guide jackets 2.1 to 2.4 can basically also be designed with different sizes. Furthermore, it is also possible to design the second galette pair 1.2 with guide jackets 2.3 and 2.4 driven in the same direction. Alternatively, the guide jackets could also be assigned and driven in such a way that the thread is looped around both galette pairs in a Z-shape.

Figure 4:
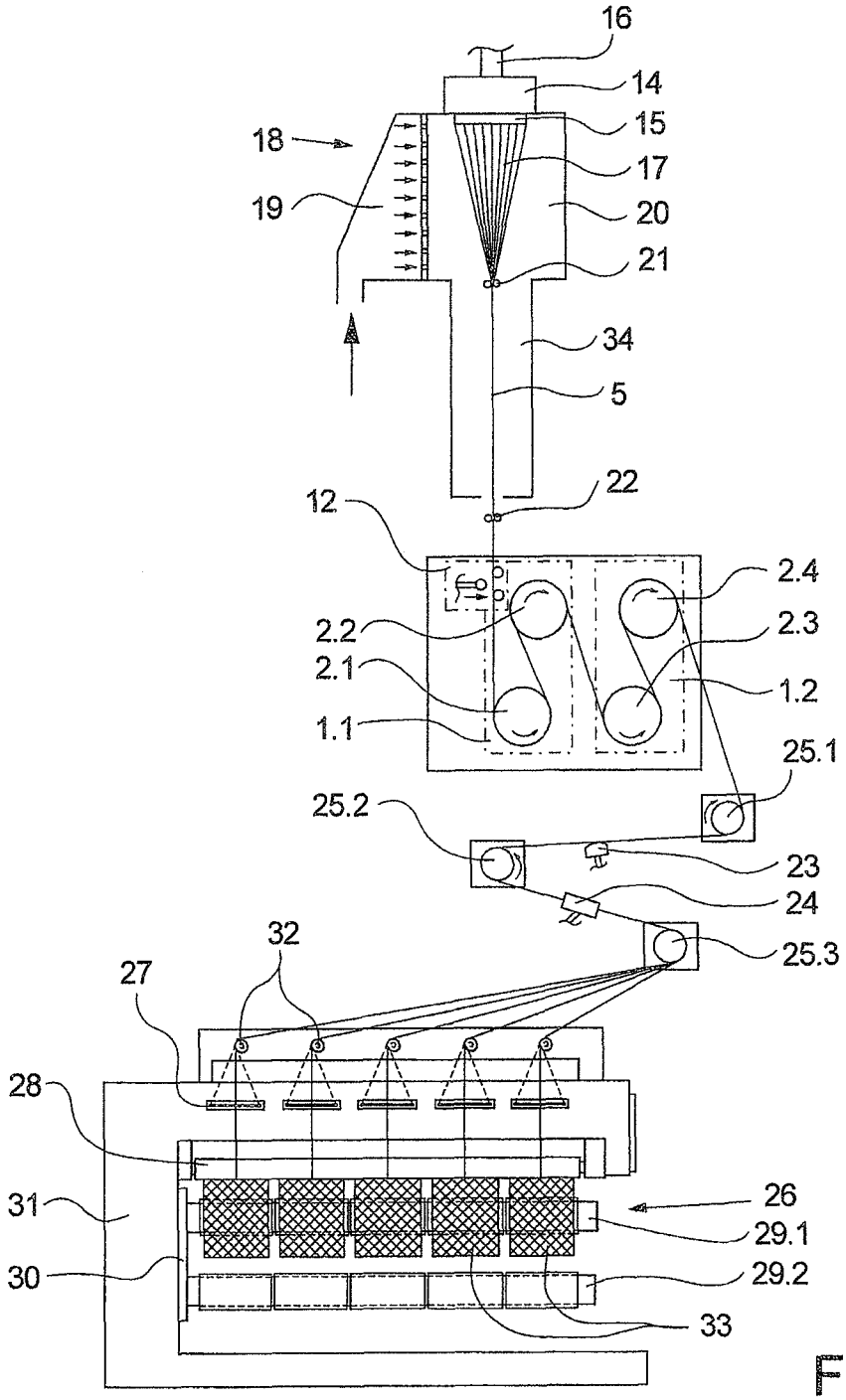
FIG. 4 shows a schematic representation of the spinning system with an exemplary embodiment of the device according to the invention.

FIG. 4 shows an exemplary embodiment of the device according to the invention for performing the method according to the invention within a spinning system.

A heated spinning beam 14 is provided for melt spinning of preferably a plurality of multifilament threads, having a plurality of spinning nozzles 15 on its underside. The spinning beam 14 is aligned diagonally to the drawing plane, so that only one of the spinning nozzles 15 is visible in FIG. 4. Each of the spinning nozzles 15 has a multitude of nozzle openings on its underside, through which a polymer melt is extruded to form filaments 17 for example from a polyester or a polyamide. The spinning nozzles 15 are connected with a molten material inlet 16. The molten material inlet 16 is coupled to a molten material source not illustrated here, for example an extruder. Other molten material-carrying and molten material-transporting components can be arranged within the spinning beam 14, which are not discussed in more detail here.

A cooling system 18 is provided underneath the spinning beam 14, consisting of a cooling shaft 20 and an airflow device 19. The cooling shaft 20 is arranged underneath the spinning nozzles 15 in such a way that the plurality of filaments 17 extruded through the spinning nozzles 15 pass through the cooling shaft 18. A cool air flow can be generated by means of the airflow device 18, which is directed into the cooling shaft 20 so that the filaments 17 extruded through the spinning nozzles 15 are cooled off uniformly. A shared thread guide 21 is provided underneath the cooling shaft 20 to combine the filaments 17 to a thread 5. For this purpose, the shared thread guide 21 is arranged in the center underneath the spinning nozzles 14 so that the filaments 17 are uniformly brought together in the shared thread guide 21.

The device according to the invention for drawing the threads is arranged underneath a fall shaft 34 adjacent to the cooling shaft 20. For this purpose, the threads 5 are first brought to a treatment distance from each other through the intake thread guide 22, so that the threads 5 are guided parallel side by side with a short distance ranging from 3 to 8 mm above the guide jackets 2.1 to 2.4 of the galette pairs 1.1 and 1.2. The design of the galette pairs 1.1 and 1.2 arranged underneath the fall shaft 34 is identical to the exemplary embodiment according to FIG. 1 mentioned above and therefore, no further explanation is provided here.

We would only like to mention that the electric motors of the galette pairs 1.1 and 1.2 are controlled with two separate motor control devices, allowing the setting of a different speed between the first galette pair 1.1 and the second galette pair 1.2 for drawing the threads. However, the guide jackets 2.3 and 2.4 of the second galette pair 1.2 may have different exterior diameters in order to obtain a minor speed difference for a shrinkage treatment with identical rotational speeds.

A guide medium 12 in the form of a thread brake is arranged in the thread course in front of the first galette pair 1.1 through which the filaments 17 of a thread 5 can be spread to form a ribbon.

A preparation system 23 and a swirling system 24 are arranged between several individual galettes 25.1, 25.2 and 25.3 underneath the galette pairs 1.1 and 1.2. Filament cohesion is created on the threads 5 by means of preparation and swirling before they are wound up.

A winding device 26 is provided for winding up the drawn threads, which comprises a pivotable spindle rest 30 having two projecting winding spindles 29.1 and 29.2. The spindle rest 30 is retained in a rack 31. In the process, the winding spindles 29.1 and 29.2 can alternately be guided into an operating area for winding a spool and into an exchange area for exchanging the spools. An exchange device 27 and a pressure roller 28 are provided in the rack 31, for winding the threads 5 to one spool 33 each. A return pulley 32 is assigned to each winding spot above the exchange device 27, through which the inlet of the threads 5 is guided through the winding spots.

In the exemplary embodiment of the spinning machine illustrated in FIG. 4, the freshly extruded thread 5 is guided directly to the galette pairs 1.1 and 1.2 after the melt spinning process with the filaments 17 in dry condition and drawn to form an FDY yarn.

However, alternatively it is also possible to moisturize the thread 5 with a preparation agent prior to the drawing process when the filaments are gathered, said preparation agent being as dry as possible. It has been determined, that especially the water content in the preparation agent requires more energy to heat the thread to a gas conversion temperature. Insofar, preparation agents have proven suitable which have a water content of less than 20%, preferably less than 10%.

However, it is also possible to add the quantity of preparation agent to the thread with several partial preparation applications. For example, a first part of the preparation could be added to the thread directly after the spinning and before the drawing process. A very tiny quantity of preparation agent would be used to improve the gliding properties of the thread on thread guides and the guide jackets. The moistening required for the after-treatment of the thread could then be added after the drawing and before the winding process with a second part of the preparation.

The invention claimed is:

1. A method for removing and drawing a synthetic thread to form a fully drawn yarn (FDY), said method comprising:

foaming the thread by joining a plurality of extruded filaments; and guiding the thread by contact on the circumference of heated guide jackets of first and a second driven galette pairs, wherein the thread is guided in an S-shaped or Z-shaped thread course through the first galette pair having two guide jackets driven in opposite directions during the removal from a spinning zone and before the drawing and wherein the thread is guided in an S-shaped or Z-shaped thread course through the second galette pair having two guide jackets driven in opposite directions after the drawing procedure, wherein the thread is fully drawn in a drawing zone formed allied between the first and the second galette pairs.

2. The method according to claim 1, wherein the thread is guided on the guide jackets of one of the galette pairs with a single partial loop each with a loop angle of at least 200°.

3. The method according to claim 1, wherein the two guide jackets of the first galette pair are heated to an identical surface temperature ($T_1$) or to different surface temperatures ($T_1$; $T_2$) for heating the thread before the drawing procedure.

4. The method according to claim 1, wherein the two guide jackets of the second galette pair are heated to an identical surface temperature ($T_3$) or to different surface temperatures ($T_3$; $T_4$) for heating the thread after the drawing procedure.

5. The method according to claim 3, wherein the contact lengths between the thread and the guide jackets of one of the galette pairs or the guide jackets of both galette pairs are essentially designed with identical or different lengths.

6. The method according to claim 1, wherein the thread is drawn in a dry condition or in a moist condition with a water content of <20%.

7. The method according to claim 1, wherein the filaments of the thread are guided into a ribbon-shaped arrangement before a first contact with the guide jackets of the galette pairs.

8. The method according to claim 1, wherein the thread is guided along the circumference of the guide jackets of the first galette pair with a circumferential speed in the range of 1,200 m/min to 3,500 m/min and along the circumference of the guide jackets of the second galette pair with a second circumferential speed in the range of 3,500 m/min to 6,000 m/min.

9. The method according to claim 1, wherein the thread is additionally heated contactless with infrared irradiation before and/or after the drawing procedure.

10. A device for removing and drawing a synthetic thread to form a fully drawn yarn (FDY), said device comprising:

first and a second galette pairs, on the driven and heated guide jackets of which at least one thread is guided for removing and drawing, wherein the drives of the guide jackets of the first galette pair are formed with two electric motors with different senses of rotation and wherein the drives of the guide jackets of the second galette pair are formed with two electric motors with different senses of rotation, wherein the guide jackets of the first and second galette pairs provide a drawing zone for fully drawing the yarn between them and the first galette pair can be driven in respectively opposite or identical directions with the assigned electric motors compared to the respective directions of the second galette pair.

11. The device according to claim 10, wherein the guide jackets of the galette pairs are arranged among each other in such a way that the thread can be guided along the guide jackets of the galette pairs with one single partial loop each with a loop angle of at least 180°.

12. The device according to claim 10, wherein a separate heating system is assigned to each guide jacket, which can be controlled independently from each other with a plurality of control devices to set a surface temperature on the respective guide jacket.

13. The device according to claim 10, wherein the outer diameter of the guide jackets of a galette pair are identical to form identical contact lengths between the thread and the guide jacket with the same size of partial loop.

14. The device according to claim 10, wherein a guide medium is arranged in front of the thread course of the first galette pair, through which the filaments of the thread can be converted into a ribbon-shaped arrangement.

15. The method according to claim 6, wherein the thread is drawn in a moist condition with a water content of <10%.

* * * * *

UNITED STATES PATENT AND TRADEMARK OFFICE

CERTIFICATE OF CORRECTION

PATENT NO. : 8,881,497 B2
APPLICATION NO. : 13/383493
DATED : November 11, 2014
INVENTOR(S) : Zenzen It is certified that error appears in the above-identified patent and that said Letters Patent is hereby corrected as shown below:

In the Claims

Column 10,
Line 4, "foaming the thread" should read --forming the thread--;
Line 17, "formed allied between" should read --formed between--.

Signed and Sealed this
Sixteenth Day of June, 2015

Michelle K. Lee

Michelle K. Lee
*Director of the United States Patent and Trademark Office*